US009732624B2

(12) United States Patent
Singh et al.

(10) Patent No.: US 9,732,624 B2
(45) Date of Patent: Aug. 15, 2017

(54) HOT ENVIRONMENT VANE ANGLE MEASUREMENT

(71) Applicant: Hamilton Sundstrand Corporation, Charlotte, NC (US)

(72) Inventors: Bhupindar Singh, West Hartford, CT (US); Gregory DiVincenzo, Wethersfield, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 455 days.

(21) Appl. No.: 14/328,252

(22) Filed: Jul. 10, 2014

(65) Prior Publication Data

US 2016/0010491 A1 Jan. 14, 2016

(51) Int. Cl.

| | |
|---|---|
| ***F01D 17/02*** | (2006.01) |
| ***F01D 21/00*** | (2006.01) |
| ***F01D 9/02*** | (2006.01) |
| ***F01D 25/24*** | (2006.01) |
| *F01D 17/10* | (2006.01) |
| *F01D 17/00* | (2006.01) |
| *F01D 17/12* | (2006.01) |
| *F01D 17/16* | (2006.01) |
| *F01D 17/14* | (2006.01) |

(52) U.S. Cl.

CPC ..... *F01D 21/003* (2013.01); *F01D 9/02* (2013.01); *F01D 17/02* (2013.01); *F01D 17/162* (2013.01); *F01D 25/24* (2013.01); *F01D 17/00* (2013.01); *F01D 17/10* (2013.01); *F01D 17/12* (2013.01); *F01D 17/14* (2013.01); *F01D 17/16* (2013.01); *F05D 2260/74* (2013.01)

(58) Field of Classification Search

CPC ..... F01D 17/00; F01D 17/02; F01D 17/10; F01D 17/12; F01D 17/14; F01D 17/16; F01D 17/162; F01D 21/003

See application file for complete search history.

(56) References Cited

U.S. PATENT DOCUMENTS

| | | | |
|---|---|---|---|
| 4,279,568 | A | 7/1981 | Munroe |
| 5,601,401 | A | 2/1997 | Matheny et al. |
| 5,873,696 | A | 2/1999 | Harada et al. |
| 6,341,238 | B1 | 1/2002 | Modeen et al. |

(Continued)

FOREIGN PATENT DOCUMENTS

| | | | | |
|---|---|---|---|---|
| CH | WO 2008155402 | A1 * | 12/2008 | ..... F01D 17/162 |
| EP | 1895267 | A1 | 3/2008 | |

(Continued)

OTHER PUBLICATIONS

European Search Report for EP Application No. 15167150.0 issued Dec. 15, 2015.

*Primary Examiner* — Kenneth Bomberg
*Assistant Examiner* — Behnoush Haghighian
(74) *Attorney, Agent, or Firm* — Cantor Colburn LLP

(57) ABSTRACT

A turbine is provided and includes an outer duct, a turbine casing formed to define a turbine interior, the turbine casing being disposed within the outer duct to define an annulus, a vane element pivotably coupled to the turbine casing via a spindle to extend spanwise into the turbine interior and a sensor element supportively coupled to the outer duct and configured to sense a characteristic of the spindle within the annulus from which a pivot angle of the vane element is derivable.

13 Claims, 3 Drawing Sheets

(56) References Cited

U.S. PATENT DOCUMENTS

| | | | | |
|---|---|---|---|---|
| 6,473,705 | B1 * | 10/2002 | Conners | G01F 1/661 250/343 |
| 6,895,751 | B1 | 5/2005 | Greentree | |
| 7,095,221 | B2 | 8/2006 | Bosselmann et al. | |
| 7,426,829 | B2 | 9/2008 | Greentree | |
| 7,901,178 | B2 | 3/2011 | Giaimo et al. | |
| 7,927,067 | B2 | 4/2011 | Rajamani et al. | |
| 8,591,173 | B2 | 11/2013 | Bouru et al. | |
| 8,668,444 | B2 | 3/2014 | Jarrett, Jr. et al. | |
| 2008/0273965 | A1 * | 11/2008 | Rajamani | F01D 17/02 415/129 |
| 2009/0285673 | A1 | 11/2009 | Giaimo et al. | |

FOREIGN PATENT DOCUMENTS

| | | | |
|---|---|---|---|
| EP | 1988258 | A2 | 11/2008 |
| EP | 2006495 | A1 | 12/2008 |
| EP | 2336498 | A1 | 6/2011 |

* cited by examiner

HOT ENVIRONMENT VANE ANGLE MEASUREMENT

FEDERAL RESEARCH STATEMENT

This invention was made with government support under N00014-09-D-0821-0006 awarded by the Navy. The government has certain rights in the invention.

BACKGROUND OF THE INVENTION

The subject matter disclosed herein relates to vane angle measurement and, more particularly, to vane angle measurement in a hot environment of a turbine casing.

A typical aircraft includes a fuselage, wings connected to opposite sides of the fuselage, a tail portion disposed at a trailing end of the fuselage and aircraft engines. The aircraft engines may be supported within nacelles that are connected to lower sides of the wings, for example. The aircraft engines include turbines in which fuel and compressed air that have been mixed and combusted are expanded to generate power and thrust.

In an aircraft engine, a performance and efficiency of turbine operation is at least partially reliant upon a vane angle of turbine vanes being controlled. Indeed, in many cases, the turbine vanes in the turbine need to be at precise locations and need to be precisely angled at those locations. Therefore, it is often necessary to measure the precise angle of turbine vane so that a determination can be made as to whether a vane angle adjustment is required.

BRIEF DESCRIPTION OF THE INVENTION

According to one aspect of the invention, a turbine is provided and includes an outer duct, a turbine casing formed to define a turbine interior, the turbine casing being disposed within the outer duct to define an annulus, a vane element pivotably coupled to the turbine casing via a spindle to extend spanwise into the turbine interior and a sensor element supportively coupled to the outer duct and configured to sense a characteristic of the spindle within the annulus from which a pivot angle of the vane element is derivable.

In accordance with additional or alternative embodiments, the sensor element is further configured to generate data reflective of the characteristic and the turbine further includes a processing unit configured to derive the pivot angle of the vane element from the data and a communication system by which the processing unit is receptive of the data from the sensor element.

In accordance with additional or alternative embodiments, a magnitude of the pivot angle is derived in accordance with a baseline angle.

In accordance with additional or alternative embodiments, the temperatures within the turbine interior exceed temperatures within the annulus by about 1,000-1,500° F.

In accordance with additional or alternative embodiments, the sensor element is configured to electro-magnetically, optically, capacitatively or mechanically sense the characteristic.

In accordance with additional or alternative embodiments, the sensor element includes a microwave sensor including a waveguide, the spindle includes a threaded screw pivotable with the vane element to be linearly moved relative to the waveguide and the characteristic includes a linear distance between complementary ends of the waveguide and the threaded screw.

In accordance with additional or alternative embodiments, the sensor element includes a capacitative sensor including a conductive element, spindle element includes a threaded screw pivotable with the vane element to be linearly moved relative to the conductive element and the characteristic includes a linear distance between complementary ends of the conductive element and the threaded screw.

According to another aspect of the invention, an aircraft is provided and includes an aircraft engine. The aircraft engine includes a turbine and the turbine includes an outer duct, a turbine casing formed to define a turbine interior, the turbine casing being disposed within the outer duct to define an annulus, a vane element pivotably coupled to the turbine casing via a spindle to extend spanwise into the turbine interior and a sensor element supportively coupled to the outer duct and configured to sense a characteristic of the spindle within the annulus from which a pivot angle of the vane element is derivable.

According to yet another aspect of the invention, a vane angle measurement apparatus for operable disposition within a low temperature environment surrounding a high temperature environment is provided. The apparatus includes a spindle by which a vane element is pivotably supported to extend spanwise into the high temperature environment and a sensor element configured to sense a characteristic of the spindle within the low temperature environment from which a pivot angle of the vane element is derivable.

In accordance with additional or alternative embodiments, the sensor element is further configured to generate data reflective of the characteristic and the apparatus further includes a processing unit configured to derive the pivot angle of the vane element from the data and a communication system by which the processing unit is receptive of the data from the sensor element.

In accordance with additional or alternative embodiments, the magnitude of the pivot angle is derived in accordance with a baseline angle.

In accordance with additional or alternative embodiments, the temperatures within the high temperature environment exceed temperatures within the low temperature environment by about 1,000-1,500° F.

In accordance with additional or alternative embodiments, the sensor element is configured to electro-magnetically, optically, capacitatively or mechanically sense the characteristic.

In accordance with additional or alternative embodiments, the sensor element includes a microwave sensor including a waveguide, the spindle includes a threaded screw pivotable with the vane element to be linearly moved relative to the waveguide and the characteristic includes a linear distance between complementary ends of the waveguide and the threaded screw.

In accordance with additional or alternative embodiments, the sensor element includes a capacitative sensor including a conductive element, the spindle includes a threaded screw pivotable with the vane element to be linearly moved relative to the conductive element, and the characteristic includes a linear distance between complementary ends of the conductive element and the threaded screw.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In an aircraft engine, a turbine is disposed and configured to generate thrust and a performance and efficiency of turbine operation is at least partially reliant upon a vane angle of turbine vanes being controlled. Indeed, in many cases, the turbine vanes in the turbine need to be at precise locations and need to be precisely angled at those locations. Therefore, it is often necessary to measure the precise angle of turbine vane so that a determination can be made as to whether a vane angle adjustment is required. Unfortunately, turbine vanes are generally disposed in a hot environment (i.e., greater than 2000° F.) with little available spacing where conventional angle measurement sensors cannot operate.

Accordingly and, as described below, indirect measurement sensors for sensing turbine vane angles can be used. Such sensors may be provided as microwave sensors, for example, but since microwave sensors can measure linear distances more easily than angular displacements, turbine vane angle movements are converted into linear distances via a screw-type turbine vane spindle. The resulting measurement of the linear distance between the sensor and the spindle can then be converted into an angular measurement using a known relationship of spindle angle movement to linear distance.

Figure 1:
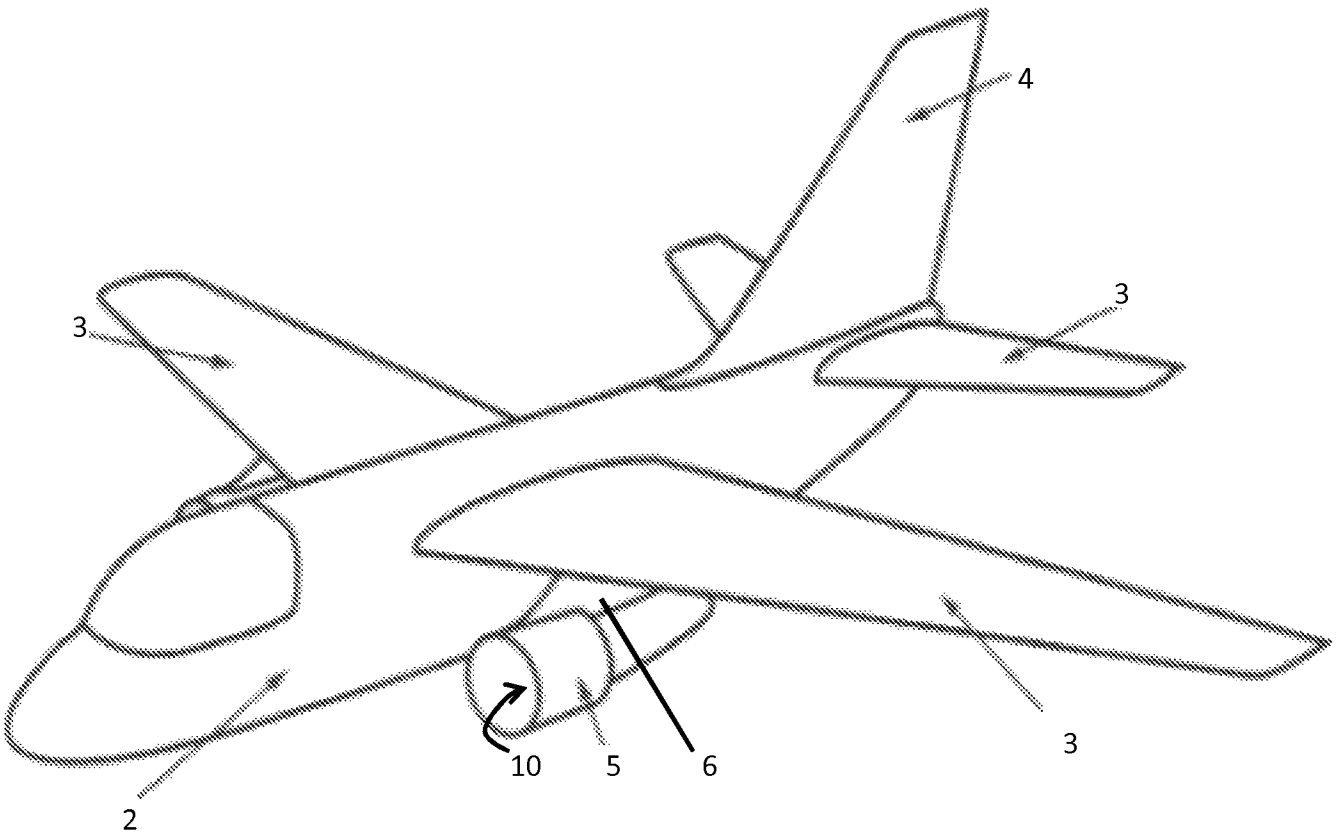
FIG. 1 is a perspective view of an aircraft in accordance with embodiments.

With reference to FIG. 1, an aircraft 1 is provided. The aircraft 1 includes a fuselage 2, wings 3, which are connected to opposite sides of the fuselage 2, a tail portion 4, which is disposed at a trailing end of the fuselage 2 and aircraft engines 5. The aircraft engines 5 may be supported within nacelles 6 that are connected to lower sides of the wings 3, for example. The aircraft engines 5 include turbines 10 (see FIGS. 2 and 3) in which fuel and compressed air that have been mixed and combusted are expanded to generate power and thrust.

Figure 3:
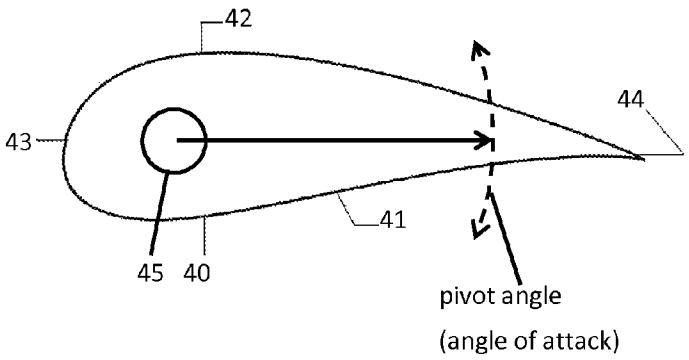
FIG. 3 is a radial view of a vane element of the turbine of FIG. 2.
Figure 2:
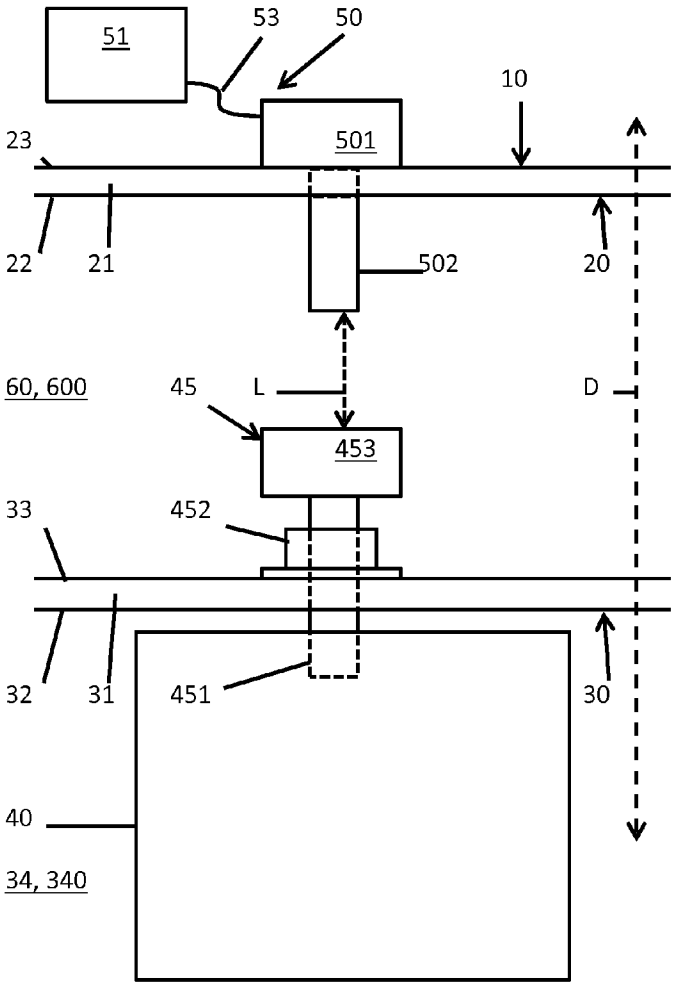
FIG. 2 is a side schematic view of a portion of a turbine of the aircraft of FIG. 1.

With reference to FIGS. 2 and 3, a portion of one of the turbines 10 of the aircraft 1 of FIG. 1 includes an outer duct 20, a turbine casing 30, a vane element 40 and a sensor element 50. The outer duct 20 may be provided as a substantially annular body 21 having an interior facing surface 22 and an exterior facing surface 23. The turbine casing 30 may also be provided as a substantially annular body 31 having an interior facing surface 32 and an exterior facing surface 33. In the case of the turbine casing 30, the interior facing surface 32 of the annular body 31 is formed to define a turbine interior 34, which is receptive of the fuel and compressed air that have been combusted and is thus a high temperature environment 340. The turbine casing 30 is disposed within the outer duct 20 to thereby define an annulus 60 extending in a spanwise dimension D between the interior facing surface 22 of the annular body 21 and the exterior facing surface 33 of the annular body 31. The annulus 60 is formed to define a flow path about the turbine casing 30 for various fluids and gases as well as foreign objects, such as dust and moisture.

In accordance with embodiments, temperatures within the high temperature environment 340 of the turbine interior 34 may be between about −40 to about 1,500-2,500° F. or more. By contrast, temperatures within the annulus 60 may be between about −40 to about 500-1,000° F. or more such that temperatures within the high temperature environment 340 can exceed temperatures within the annulus 60 by about 1,000-1,500° F. or more. Thus, the annulus 60 may be regarded as a low temperature environment 600 at least in comparison to the turbine interior 34.

The vane element 40 may be provided as a plurality of vane elements 40 that are arranged in one or more annular arrays at various turbine stages. For purposes of clarity and brevity, however, only a single vane element 40 of a single turbine stage will be discussed though it will be understood that the descriptions provided herein are applicable for multiple vane elements 40 at multiple turbine stages. The vane element 40 is pivotably coupled to the turbine casing 30 via a spindle 45 to extend in the spanwise dimension D into the turbine interior 34 from a radial location proximate to the interior facing surface 32 of the annular body 31. In accordance with embodiments, the vane element 40 may have a pressure surface 41, a suction surface 42 opposite the pressure surface 41 as well as leading and trailing edges 43 and 44 defined along the spanwise dimension where the pressure surface 41 and the suction surface 42 meet. With this configuration, fluids flowing through the turbine interior 34 can aerodynamically interact with the vane element 40 and be redirected in accordance with a pivot angle (or angle of attack) of the vane element 40.

That is, where the vane element 40 has a baseline pivot angle (or an angle of attack of 0°) relative to incoming fluid flows within the turbine interior 34, the vane element 40 will tend to deflect such fluid flows by a predefined amount. If the vane element 40 were to pivot from this baseline pivot angle in a negative or a positive angle direction, the deflection of the fluid flows will respectively increase or decrease accordingly with a magnitude of the increased/decreased deflection being directly related to a magnitude of the pivoting. Since an efficiency and performance of the turbine 10 is related to precise angling of the vane element 40, accurate measurements and corrections of the pivoting of the vane element 40 is useful in improving turbine 10 efficiencies and performance.

The sensor element 50 is supportively coupled to the outer duct 20 and configured to sense a characteristic of the spindle 45 within the annulus 60. Since this sensed characteristic may be directly related to the pivot angle of the vane element 40, as will be described below, the pivot angle of the vane element 40 may be derived from the sensed characteristic. In accordance with embodiments, the sensor element 50 may include a local processing unit 51, which is configured to generate data reflective of the sensed characteristic and to derive the pivot angle of the vane element 40 from the generated data. In accordance with further embodiments, the sensor element 50 may include the local processing unit 51, which is configured to generate data reflective of the sensed characteristic, and in addition the turbine 10 may further include a computing device and a communication system 53. The communication system 53 may be a wired or wireless communication system coupled to both the local processing unit 51 and the computing device such that the computing device is receptive of the data generated by the local processing unit 51. The computing device in this case is configured to derive the pivot angle of the vane element 40 from the received data.

In accordance with various embodiments, the sensor element 50 is configured to electro-magnetically, optically, capacitatively or mechanically sense the characteristic of the vane element 40. In the case where the sensor element 50 optically senses the characteristic of the vane element 40, the spindle 45 may include a gauge that directly indicates the pivoting angle of the vane element 40 while the sensor element 50 includes an optical pickup that can read an output of the gauge. In the case where the sensor element 50 mechanically senses the characteristic of the vane element 40, the spindle 45 may include a tab, for example, while the sensor element 50 includes a stopper that is mechanically interfered with by the tab to directly register the pivoting angle of the vane element 40.

In accordance with further alternative embodiments and, as shown in FIGS. 2 and 3, the sensor element 50 may include a microwave sensor 501 that itself includes a waveguide 502 extending from the outer duct 20 and partially through the annulus 60 (or a capacitive sensor including a conductive element, which would have a similar structure and functionality as the structure shown in FIGS. 2 and 3), and the spindle 45 includes a threaded screw 451. The threaded screw 451 is secured to the vane element 40 and to the turbine casing 30 via a bolt and washer combination 452 and includes a head 453 that extends from the turbine casing 30 and partially through the annulus 60 toward the waveguide 502. Due to the threaded screw 451 being secured to the vane element 40, the threaded screw 451 is pivotable about a longitudinal axis thereof with the vane element 40 and, as a result of mechanical interference between the complementary threading of the threaded screw 451 and the bolt and washer combination 452, the head 453 of the threaded screw 451 is linearly moved relative to the waveguide 502.

With the head 453 of the threaded screw 451 being movable relative to the waveguide 502, the characteristic sensed by the sensor element 50 includes a linear distance L between complementary ends of the waveguide 502 and the head 453 of the threaded screw 451. This linear distance L is then converted into an angular value by the local processing unit 51 or the computing device from which the pivoting angle of the vane element 40 may be derived. In the alternative case where the sensor element 50 includes the capacitive sensor that itself includes the conductive element, the sensed characteristic may include a capacitance between the conductive element and the head 453 where such capacitance is indicative of the distance L. In accordance with still other embodiments, other configurations for sensing the distance L may be used including, but not limited to, radar, infrared, LIDAR or other laser sensing devices, etc.

Figure 4:
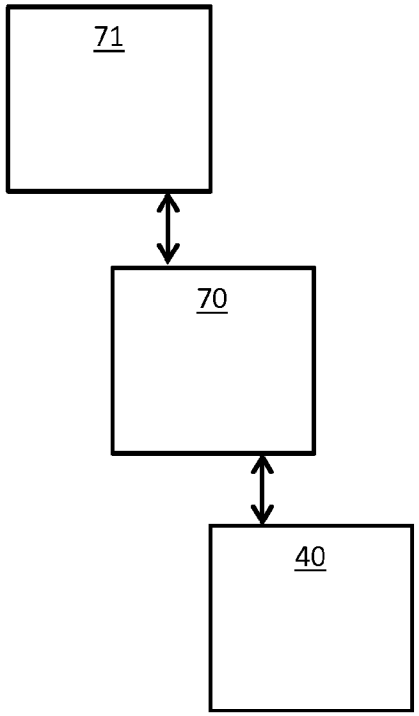
FIG. 4 is a schematic diagram of a vane element control system in accordance with embodiments.

With reference to FIG. 4, the turbine 10 may include a servo motor 70, which is coupled to the vane element 40 and configured to cause the vane element 40 to pivot, and a control element 71. The control element 71 may be disposed as a component of the computing device and/or as a component of a flight computer and is configured to issue servo commands to the servo motor 70 that instruct the servo motor 70 as to how to pivot the vane element 40. In this way, a performance parameter of the turbine 10 that is related to the pivot angle of the vane element 40 can be controlled by the control element 71 in accordance with current flight conditions and desired turbine 10 efficiencies and performance.

Figure 5:
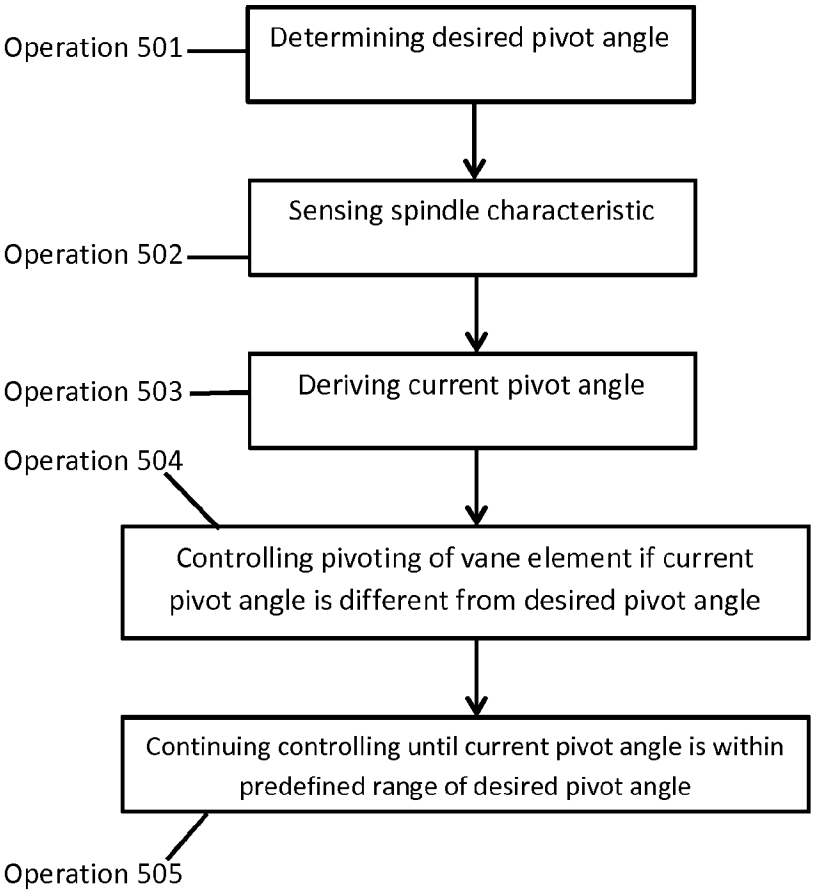
FIG. 5 is a flow diagram illustrating a vane angle measurement method in accordance with embodiments.

With reference to FIG. 5, a vane angle measurement method is provided and may be executed by one or more of the local processing unit 51, the computing device and/or the control element 71. The method initially includes determining a desired pivot angle for the vane element 40 in accordance with current flight conditions and desired turbine 10 efficiencies and performance (operation 501). The method then includes sensing the above-noted characteristic of the spindle 45 (operation 502) and deriving a current pivot angle of the vane element 40 from a result of the sensing (operation 503). At this point, if the derived current pivot angle is different from the desired pivot angle, the method includes controlling a pivoting of the vane element 40 via the servo motor 70 in order to correct the current pivot angle (operation 504) and continuing the controlling until the current pivot angle is within a predefined range of the desired pivot angle (operation 505).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine, comprising:

an outer duct;

a turbine casing formed to define a turbine interior, the turbine casing being disposed within the outer duct to define an annulus;

a vane element pivotably coupled to the turbine casing via a spindle to extend spanwise into the turbine interior, the spindle comprises a threaded screw pivotable with the vane element to be linearly moved relative to the waveguide; and a sensor element supportively coupled to the outer duct and configured to sense a characteristic of the spindle within the annulus from which a pivot angle of the vane element is derivable, the sensor element comprises a microwave sensor including a waveguide and the characteristic comprises a linear distance between complementary ends of the waveguide and the threaded screw.

2. The turbine according to claim 1, wherein the sensor element is further configured to generate data reflective of the characteristic and the turbine further comprises:

a processing unit configured to derive the pivot angle of the vane element from the data; and a communication system by which the processing unit is receptive of the data from the sensor element.

3. The turbine according to claim 1, wherein a magnitude of the pivot angle is derived in accordance with a baseline angle.

4. The turbine according to claim 1, wherein temperatures within the turbine interior exceed temperatures within the annulus by about 1,000-1,500° F.

5. The turbine according to claim 1, wherein the sensor element is configured to electro-magnetically, optically, capacitatively or mechanically sense the characteristic.

6. The turbine according to claim 1, wherein:

the sensor element comprises a capacitative sensor including a conductive element, the spindle comprises a threaded screw pivotable with the vane element to be linearly moved relative to the conductive element, and the characteristic comprises a linear distance between complementary ends of the conductive element and the threaded screw.

7. An aircraft comprising an aircraft engine including the turbine according to claim 1.

8. A vane angle measurement apparatus for operable disposition within a low temperature environment surrounding a high temperature environment, the apparatus comprising:

a spindle by which a vane element is pivotably supported to extend spanwise into the high temperature environment; and a sensor element configured to sense a characteristic of the spindle within the low temperature environment from which a pivot angle of the vane element is derivable, the sensor element comprises a capacitative sensor including a conductive element, the spindle comprises a threaded screw pivotable with the vane element to be linearly moved relative to the conductive element, and the characteristic comprises a linear distance between complementary ends of the conductive element and the threaded screw.

9. The apparatus according to claim 8, wherein the sensor element is further configured to generate data reflective of the characteristic and the apparatus further comprises:

a processing unit configured to derive the pivot angle of the vane element from the data; and a communication system by which the processing unit is receptive of the data from the sensor element.

10. The apparatus according to claim 8, wherein a magnitude of the pivot angle is derived in accordance with a baseline angle.

11. The apparatus according to claim 8, wherein temperatures within the high temperature environment exceed temperatures within the low temperature environment by about 1,000-1,500° F.

12. The apparatus according to claim 8, wherein the sensor element is configured to electro-magnetically, optically, capacitatively or mechanically sense the characteristic.

13. The apparatus according to claim 8, wherein:

the sensor element comprises a microwave sensor including a waveguide, the spindle comprises a threaded screw pivotable with the vane element to be linearly moved relative to the waveguide, and the characteristic comprises a linear distance between complementary ends of the waveguide and the threaded screw.

* * * * *